US007147390B2

(12) United States Patent
Piccinino, Jr. et al.

(10) Patent No.: US 7,147,390 B2
(45) Date of Patent: Dec. 12, 2006

(54) REPLENISHMENT SYSTEM FOR A PRINT MEDIA PROCESSOR

(75) Inventors: Ralph L. Piccinino, Jr., Rush, NY (US); Kevin H. Blakely, Rochester, NY (US); Daniel C. Davis, Rush, NY (US); Kenneth D. Corby, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 120 days.

(21) Appl. No.: 10/930,671

(22) Filed: Aug. 31, 2004

(65) Prior Publication Data

US 2006/0045518 A1 Mar. 2, 2006

(51) Int. Cl.
*G03D 3/08* (2006.01)

(52) U.S. Cl. ..... 396/626; 355/27; 134/64 P

(58) Field of Classification Search ..... None
See application file for complete search history.

(56) References Cited

U.S. PATENT DOCUMENTS 5,432,583 A * 7/1995 Ishikawa et al. ..... 396/626
5,694,991 A 12/1997 Harris et al.
6,364,545 B1 4/2002 Horn et al. ..... 396/578
6,402,397 B1 6/2002 Piccinino, Jr. et al. ..... 141/346
6,637,467 B1 10/2003 Piccinino, Jr. et al. ..... 141/2
6,705,779 B1 * 3/2004 Castellarin et al. ..... 396/578

* cited by examiner

*Primary Examiner*—D. Rutledge
(74) *Attorney, Agent, or Firm*—David A. Novais; Kathleen Neuner Manne

(57) ABSTRACT

A system for supplying a processing solution to a printing device, such as a photographic processor or a printer, which includes a supply tank with processing solution or ink and a delivery system between the supply tank and a printing device. The delivery system has a retaining vessel with retained fluid, in the vessel, and a reference probe to signal a level probe when fluid reaches a predetermined level on receipt of a replenish signal from the controller for the printing device. The power supply actuates a three-way valve in order to flow a volume of the processing solution from the supply tank to the retaining vessel. A power supply receives the adjustable liquid level probe signal from the adjustable liquid level probe. Then switches the three-way valve to flow the retained fluid from the retaining vessel to the printer.

16 Claims, 4 Drawing Sheets

REPLENISHMENT SYSTEM FOR A PRINT MEDIA PROCESSOR

FIELD OF THE INVENTION

The present embodiments relate to a system for providing replenishment fluids to a print system or a photographic mini-lab, such as a self service kiosk.

BACKGROUND OF THE INVENTION

Small mini-labs are used for the processing of film and/or paper. In such minilabs, the replenishment solution used for replenishing the processing solutions in the processing tanks is provided in a combined shipping and dispensing package, such as illustrated in U.S. Pat. No. 5,577,614.

Combined shipping and dispensing packages allow for an untrained operator of the minilab or print system to provide fresh replenishment solution to the minilab or system quickly and easily. Typically, the shipping and dispensing packages have numerous individual containers, each having a different processing solution designed to be emptied simultaneously such that a fresh package can be placed without wasting processing solution.

In order to improve the emptying of all the containers at the same time, prior art systems provide highly accurate feed pumps for delivery of the processing solutions from the package to the processing tanks so that an exact amount of processing solution is delivered. This solution is relatively expensive as the highly accurate pumps are expensive items.

Another problem with current minilabs is that the minilabs do not provide any feedback to the operator if a pump malfunctions; it simply stops working. Also there are no visual indicators which reveal the amount of the replenishment solution delivered. There is a need to overcome these problems.

Prior art devices have suggested various techniques for determining when fluid supply containers have been emptied. One such system relies on the placement of a sensor adjacent to the neck of a container. When a collar floats down in the container to the sensor, the sensor sends a signal to the operator that the fluid supply is empty. The collar moves in response to the position of the fluid in the container. When empty, the collar goes to a position that activates the sensor to alert the user that the container is empty. Occasionally, defects in container manufacturing may cause the floating collar to stick and fail to drop when the package is empty. In other situations, a false empty alarm may be activated due to sensor failure or when the sensors are in need of cleaning or maintenance. An example of use of such sensors is disclosed in U.S. Pat. No. 5,694,991.

Other solutions include systems that are directed to supplying processing solution from a single large supply container into an associated processing tank, typically operated in a continuous manner. When the solution in the supply container reaches a low level, a skilled attendant simply provides more solution to the supply vessel. Packaged chemistry is not suitable for such systems nor is there any concern for associating the refilling of one supply vessel with another supply vessel in these systems.

A need exists for an accurate and economical fluid delivery system to provide replenishment solutions to photographic processors that utilize a replenishment package system having two or more processing solutions that are to be depleted simultaneously.

A need exists for an accurate delivery system which is low in cost to manufacture that dispenses the replenishment solution and provides the ability to alert an operator to delivery problems that is faster and better than those that already exist. The present invention meets these needs.

SUMMARY OF THE INVENTION

The invention relates to a method and a system for supplying a processing solution (for example, a replenishment solution) and/or ink, to a printing device such as a minilab or an ink jet or other printer which uses a supply tank with processing solution and/or ink, and a delivery system connected between the supply tank and the printer head or printing equipment. The delivery system includes a retaining vessel for holding a retained fluid and an adjustable liquid level probe that can be set to sense a predetermined amount of the retained fluid in the retaining vessel. When the system receives a signal from the printer to replenish the three-way valve will move to fill the retaining vessel. A reference probe in the delivery system provides a signal to the adjustable liquid level probe when full. A power supply receives the signal and moves a three-way valve to empty the retaining vessel in response to the adjustable liquid level probe signal. The three-way valve directs the predetermined volume of the retained fluid from the retaining vessel to the printer and then waits for the next replenish cycle signal.

BRIEF DESCRIPTION OF THE DRAWINGS

In the detailed description of the preferred embodiments presented below, reference is made to the accompanying drawings, in which.

The present embodiments are detailed below with reference to the listed figures.

DETAILED DESCRIPTION OF THE INVENTION

Before explaining the present embodiments in detail, it is to be understood that the embodiments are not limited to the particular descriptions and that it can be practiced or carried out in various ways.

The systems and methods embodied herein were designed for a variety of environments but have particular applicability to a minilab or self service kiosk environment.

A minilab environment typically requires different processing solutions flowing into different containers and preferably does use pumps or other electrical equipment which increases minilab operating costs.

The present invention enables different solutions to be used in a minilab with lower costs for refill than traditional system replenishment systems. Maintenance costs are reduced since pump repair is not needed in the preferred embodiment. Also, there are fewer problems due to leakage, as the minilab is not subjected to higher than normal pressures with this system, as compared to pressurized system using pumps.

One of the benefits of the present invention is that fewer environmental spills due to burst hoses or detached equipment occurs as compared with conventional replenishment systems. When conventional systems leak, the leaking commonly occurs along pressurized lines. These leaks are an environmental problem if the fluid is a hazardous waste into the environment.

Another environment benefit derived from the embodied designs of the invention in a minilab are that less energy is needed to operate the minilab. The operation of a minilab without pumps means less power is needed than minilabs with pumps. Since pumps are not required with the embodied design of the minilab, the minilab utilizes a smaller power supply and a smaller controller. The power supply can be a standard 110-volt supply or a battery.

Figure 1:
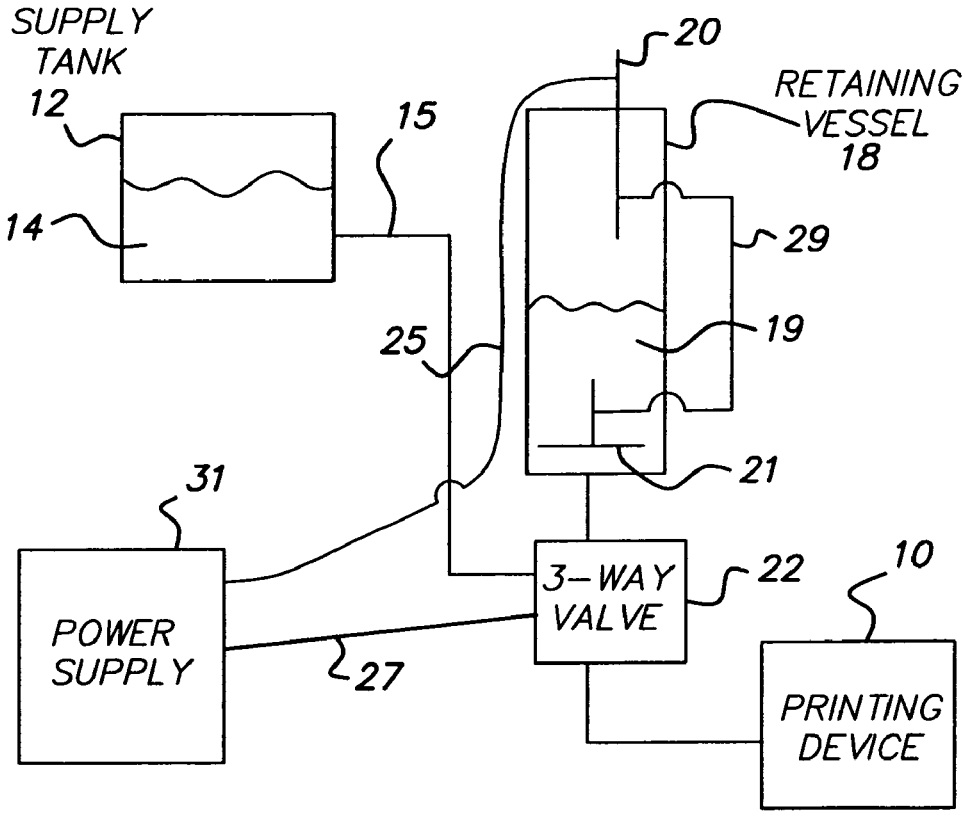
FIG. 1 is a schematic of an embodiment of a gravity fed fluid filling system with a power supply.

With reference to the figures, FIG. 1 is illustration of a gravity fed embodiment of the fluid filling system of the invention. The fluid filling system has processing solution or ink 14 in a supply tank 12 which flows fluid to a three way valve 22 and ultimately to a printing device 10 such as a photographic processor and/or a printer. A delivery system is located between the photographic processor and/or printer and the supply tank which includes the three way valve and a retaining vessel 18 which has an adjustable liquid level probe and a reference probe disposed in the retaining vessel. The retaining vessel holds retained fluid 19, which is a defined quantity of replenishment fluid 14.

A power supply 31 can be used in an embodiment to communicate with the three way valve 22 and selectively provide power to the three way valve 22 based on a probe signal 29 from an adjustable liquid level probe 20.

The processing solution 14 is typically a replenishment solution, such as a developer, a bleach, a fixer, or a stabilizer or inks which are used in photofinishing or in printing.

The adjustable liquid level probe 20 when used with a reference probe 21 creates a probe signal 29 when retained fluid 19 is in contact with reference probe 21 in the retaining vessel 18.

The delivery system includes the retaining vessel 18 for holding the volumetrically defined quantity of retained fluid 19, the adjustable liquid level probe 20 that can be set at a specific depth, and the three way valve.

The adjustable liquid level probe 20 should be made from an electrically conductive material impervious to the retained fluid 19 in the retaining vessel 18. One example of an electrically conductive material impervious to fluids in the retained vessel is stainless steel.

Power supply 31 receives a signal from printer 10 to replenish. The power supply 31 sends a signal 27 to a three-way valve 22. The three-way valve 22, typically a solenoid valve, receives the signal 27 and then flows a volume of fluid 14 to the retaining vessel 18. The adjustable liquid level probe 20 is adapted to sense a predetermined amount of retained fluid 19, typically based upon fluid contacting a portion of or covering the adjustable liquid level probe which is secured to the side of the retaining vessel 18.

Reference probe 21 provides a reference probe signal 29 to the adjustable liquid level probe 20. The adjustable liquid level probe 20 sends an adjustable liquid level probe signal 25 to the power supply 31 based on the reference probe signal 29 and information from the sensor of the adjustable liquid level probe about the level of retained fluid 19 in the retaining vessel 18.

The retained fluid 19 then flows from the retaining vessel 18, to the three way valve 22, which in turn feeds fluid to printing device 10.

Figure 2:
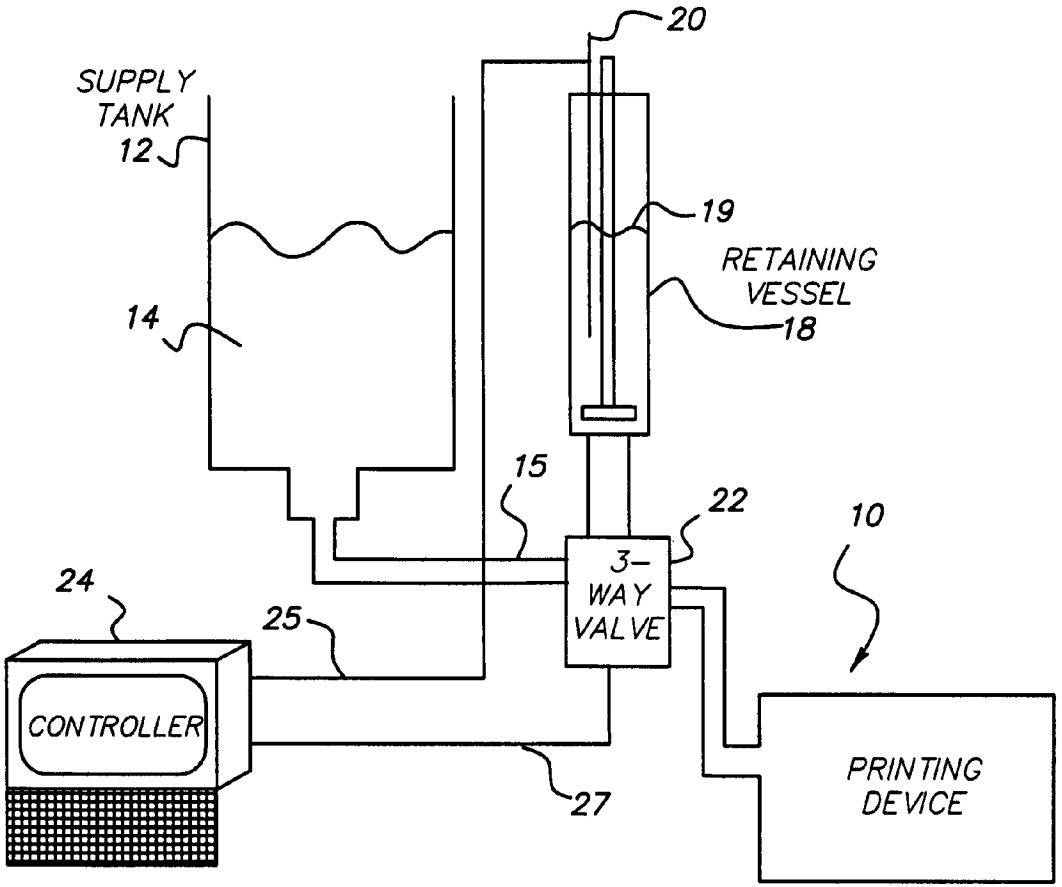
FIG. 2 is a schematic of an embodiment of a controller operated fluid filling system.

FIG. 2 depicts an embodiment where a controller 24 is used to receive the adjustable liquid level probe signal 25 from the adjustable liquid level probe 20 and transmit the signal 27 to the three way valve 22. The controller 24 compares the adjustable liquid level probe signal 25 against a preset reference level. In this embodiment, a supply tank 12 is shown to hold the processing solution 14 which is flowed into the retaining vessel 18 upon a signal from the controller 24 after the predetermined volume of retained fluid 19 is passed from the retaining vessel 18 to the printing device 10.

The printing device 10 can be a continuous ink jet printer, a drop on demand ink jet printer, a minilab, a self service photographic kiosk, or a self service printing kiosk or another photographic processing system.

It should be noted that this embodiment is similar to the first embodiment where a first predetermined volume of retained fluid 19 flows from the retained vessel 18 to the printing device 10 and then an identical defined volume of processing solution 14 flows from the supply tank 12 to the retaining vessel 18 via the conduit 15 which communicates with the three way valve 22.

Figure 3:
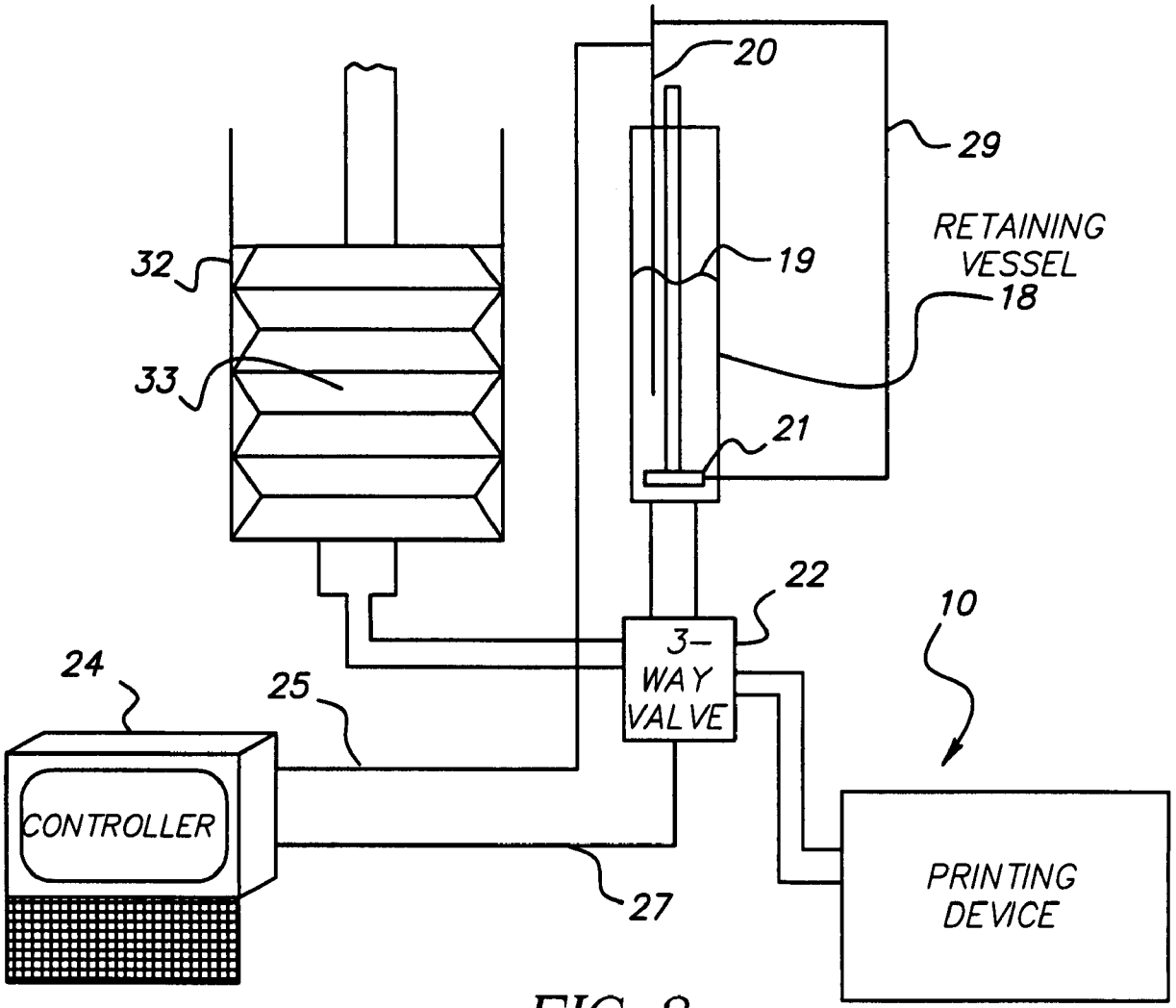
FIG. 3 depicts an embodiment of the fluid filling system using a collapsible bag in the retaining vessel.

Another embodiment of the invention contemplates using a collapsible container 32 as depicted in FIG. 3 as the supply tank. The retained fluid 19 can be placed in the collapsible container 32, which includes a collapsible bag or other collapsible container 33. Due to capillary action, the retained fluid 19 can flow into the retaining vessel 18. The retaining vessel 18 has the two probes of the prior embodiments, an adjustable liquid level probe 20 placed at a specific depth, and a reference probe 21. The reference probe then provides a reference probe signal 29 to the adjustable liquid level probe 20. The adjustable liquid level probe 20 senses a predetermined amount of retained fluid 19 in the retaining vessel 18. The adjustable liquid level probe 20 sends an adjustable liquid level probe signal 25 to the controller 24 indicating the level of retained fluid 19 in the retaining vessel 18.

When the adjustable liquid level probe signal 25 equals a preset reference in the controller 24, the controller 24 transmits a signal 27 to the three way valve 22. The controller 24 stores each defined volume of retained fluid 19 used by the printer and provides a report on demand for the total volume of retained fluid used over a specified period either on demand or on a periodic basis which is present in the controller. The signal can also be transmitted from the controller to a website. The signal 27 actuates the three-way valve 22 to move and flow the predetermined volume of retained fluid 19 from the retaining vessel 18 to the printer 10. The three-way valve 22 is left open to permit the retained fluid to flow. A signal is sent at the next replenished cycle from the controller 24 to direct the supply tank 12 to refill the retaining vessel 18 with an identical amount of processing solution 14, that is, the amount of fluid that enters the retaining vessel 18 is equivalent to the amount of fluid that flows into the printer 10.

A signal is then transmitted from the controller 24 to the three-way valve 22 to open the three-way valve 22 and the predetermined amount of fluid is re-supplied to the replenishment tank.

Figure 4:
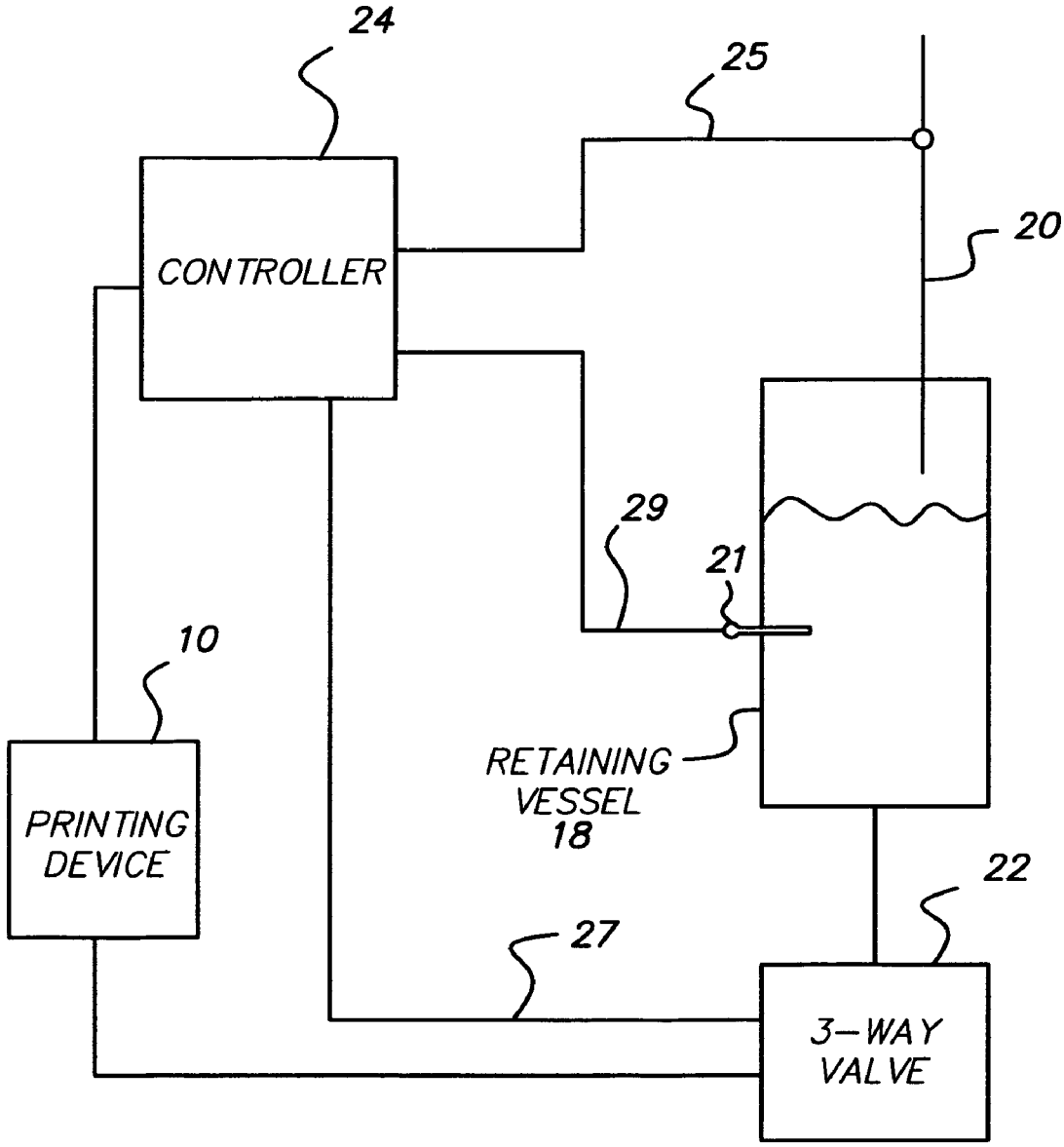
FIG. 4 depicts an electronic circuit used in FIG. 2.

FIG. 4 shows another embodiment of the invention with the printer 10 connected to the three way valve 22, and the controller 24 between the printer, three way valve and the two probes, 21 and 20, respectively.

The embodiments have been described in detail with particular reference to certain preferred embodiments thereof, but it will be understood that variations and modifications can be effected within the scope of the embodiments, especially to those skilled in the art.

PARTS LIST

10. printing device
12. supply tank
14. processing solution
15. conduit
18. retaining vessel
19. retained fluid
20. adjustable liquid level probe
21. reference probe
22. three-way valve
24. controller
25. adjustable liquid level probe signal
27. valve signal
29. reference probe signal
31. power supply
32. collapsible container
33. collapsible bag

The invention claimed is:

1. A system for supplying processing solution to a printing device comprising:

a. a supply tank adapted to hold the processing solution;
b. a printing device adapted to print images;
c. a delivery system in fluid communication between the supply tank and the printing device, wherein the delivery system comprises
  i. a retaining vessel adapted to hold a retained fluid;
  ii. an adjustable liquid level probe set at a first specific depth in the retaining vessel and adapted to sense a predetermined amount of the retained fluid in the retaining vessel; and
  iii. a reference probe set at a second specific depth and adapted to provide a reference probe signal to the adjustable liquid level probe;
d. a power supply adapted to receive the adjustable liquid level probe signal from the adjustable liquid level probe; and
e. a thee-way valve adapted to flow the sensed predetermined volume of the retained fluid from the retaining vessel to the printing device and from the supply tank to the retaining vessel when actuated by the power supply.

2. The system of claim 1, wherein the adjustable liquid level probe comprises an electrically conductive material impervious to the retained fluid.

3. The system of claim 2, wherein the electrically conductive material impervious to the retained fluid is stainless steel.

4. The system of claim 1, wherein the thee-way valve is a solenoid valve.

5. The system of claim 1, wherein the processing solution is a replenishment solution for a photoprocessing unit.

6. The system of claim 1, wherein the processing solution is a developer, a bleach, a fixer, a stabilizer or ink.

7. The system of claim 1, wherein the printing device is a continuous ink jet printer, a drop on demand ink jet printer, a minilab, a self service photographic kiosk, or a self service printing kiosk.

8. A system for supplying a processing solution to a printing device comprising:

a. a supply tank adapted to hold the processing solution;
b. a printing device adapted to print images;
c. a delivery system connected between the supply tank and the printing device, wherein the delivery system comprises
  i. a retaining vessel adapted to hold a retained fluid;
  ii. an adjustable liquid level probe set at a first specific depth in the retaining vessel and adapted to sense a predetermined amount of the retained fluid in the retaining vessel; and
  iii. a reference probe set at a second specific depth in the retaining vessel and adapted to provide a reference probe signal to the adjustable liquid level probe;
d. a controller adapted to receive the adjustable liquid level probe signal from the adjustable liquid level probe which compares the adjustable liquid level probe signal against a preset reference, and when the signal from the adjustable liquid level probe equals the preset reference transmits a signal;
e. a three-way valve adapted to receive the signal transmitted from the controller and move to permit a predetermined volume of the retained fluid from the retaining vessel to flow to the printing device or flowing an identical defined volume of the processing solution from the supply tank to the retaining vessel.

9. The system of claim 8, wherein the controller stores each defined volume of fluid used by the printer and provide a report on demand or periodically on the total volume used over a specified period.

10. The system of claim 8, wherein the three-way valve is a solenoid valve.

11. The system of claim 8, wherein the processing solution is a replenishment solution.

12. The system of claim 8, wherein the processing solution is a developer, a bleach, a fixer, a stabilizer or ink.

13. The system of claim 8, wherein the printing device is a continuous ink jet printer, a drop on demand ink jet printer, a minilab, a self service photographic kiosk, or a self service printing kiosk.

14. The system of claim 8, wherein the retaining vessel contains a collapsible container.

15. The system of claim 14, wherein the collapsible container is within the walls of the retaining vessel.

16. A method for supplying processing solution to a printing device, wherein the method comprises the steps of:

a. providing a signal from a printing device that indicates a need for fluid;
b. supplying a signal to a three-way valve to allow a predetermined amount of retained fluid from a retaining vessel to flow to the printing device;
c. sending a signal to the three way valve to refill the retaining vessel with an amount of replenishment fluid identical to the predetermined amount of retained fluid from the retaining vessel;
d. sending a signal from an adjustable liquid level probe to the three way valve to close the three-way valve.

* * * * *

UNITED STATES PATENT AND TRADEMARK OFFICE

CERTIFICATE OF CORRECTION

PATENT NO. : 7,147,390 B2
APPLICATION NO. : 10/930671
DATED : December 12, 2006
INVENTOR(S) : Ralph L. Piccinino, Jr. et al.

It is certified that error appears in the above-identified patent and that said Letters Patent is hereby corrected as shown below:

Claim 1, Column 5, Line 38, delete "thee-way" and insert -- three-way --, therefor.
Claim 4, Column 5, Line 49, delete "thee-way" and insert -- three-way --, therefor.

Signed and Sealed this

Fourteenth Day of August, 2007

JON W. DUDAS
*Director of the United States Patent and Trademark Office*